United States Patent [19]

Hare

[11] Patent Number: 4,510,790

[45] **Date of Patent: * Apr. 16, 1985**

[54] BODY AND FRAME STRAIGHTENING SYSTEM

[76] Inventor: Charles E. Hare, 23 Franklin Valley Cir., Baltimore, Md. 21136

[ * ] Notice: The portion of the term of this patent subsequent to Sep. 20, 2000 has been disclaimed.

[21] Appl. No.: 411,660

[22] Filed: Aug. 26, 1982

Related U.S. Application Data

[63] Continuation-in-part of Ser. No. 286,086, Jul. 23, 1981, Pat. No. 4,404,838.

[51] Int. Cl.[3] ..... B21D 1/12

[52] U.S. Cl. ..... 72/457; 72/705

[58] Field of Search ..... 72/457, 705

[56] References Cited

U.S. PATENT DOCUMENTS

| | | | |
|---|---|---|---|
| 1,524,753 | 2/1925 | Schwerin | 72/705 |
| 3,835,693 | 9/1974 | Majersky | 72/705 |
| 4,070,899 | 1/1978 | Venalainen | 72/705 |
| 4,238,951 | 12/1980 | Grainger et al. | 72/705 |
| 4,289,016 | 9/1981 | Hare | 72/705 |
| 4,404,838 | 9/1983 | Hare | 72/705 |

FOREIGN PATENT DOCUMENTS

| | | | |
|---|---|---|---|
| 2745807 | 4/1979 | Fed. Rep. of Germany | 72/705 |
| 338753 | 9/1971 | Switzerland | 72/705 |

*Primary Examiner*—Lowell A. Larson

*Attorney, Agent, or Firm*—John F. McClellan, Sr.

[57] ABSTRACT

An improved motor vehicle body and frame straightener of the type usable with conventional "dozers" to pull bodies and frames into shape and alignment, and having an adjustable anchor-free rectangular rail system with slidably positionable jacking provisions and laterally adjustable body grippers provides cross-slides integrally mounting the jacking provisions and laterally adjustable body grippers for better speed in set-up and better access for "dozers", while preserving facility to move the laterally adjustable body grippers without concurrent movement of the jacking provisions; grippers of two types, jaw and stud, may be interchanged by withdrawing a gripper arm and re-inserting it rotated 180°.

1 Claim, 3 Drawing Figures

BODY AND FRAME STRAIGHTENING SYSTEM

This application is a continuation-in-part of my co-pending application Ser. No. 286,086 filed July 23, 1981 now U.S. Pat. No. 4,404,838, issued Sept. 20, 1983, for SYSTEM FOR STRAIGHTENING BENT AUTOMOBILE BODIES.

FIELD OF THE INVENTION

This invention relates generally to tool systems and particularly to body and frame straightening systems for motor vehicles.

My co-pending application for U.S. patent discloses a body and frame straightening system for motor vehicles which is completely portable and lightweight, and requires no ground anchors. It provides a rectangular assembly of tubular rails having, for levelling, four jacking subassemblies and, for gripping vehicle bodies, four vehicle anchoring subassemblies separate from the jacking subassemblies.

BRIEF SUMMARY OF THE INVENTION

Objects of the present invention are to provide a variation on the invention disclosed in my copending application, which simplifies assembly, provides better access and enables simpler and faster set-up and use, in that it integrates each of the four vehicle gripping subassemblies with a respective jack subassembly.

Further objects are to provide a system as described which is stabile, durable and versatile in use and easy and quick to break down for storage and which requires minimum space for storage.

Yet further objects are to provide a system as described which can be used with better clearance for dozer operation and which can be used with most conventional dozers.

BRIEF DESCRIPTION OF THE DRAWINGS

The above and other objects and advantages will become more readily apparent on examination of the following description, including the drawings in which like reference numerals refer to like parts.

DETAILED DESCRIPTION

As indicated in my said copending application, the power to pull vehicle bodies into shape may include the use of conventional body-puller "dozers", not shown.

Figure 1:
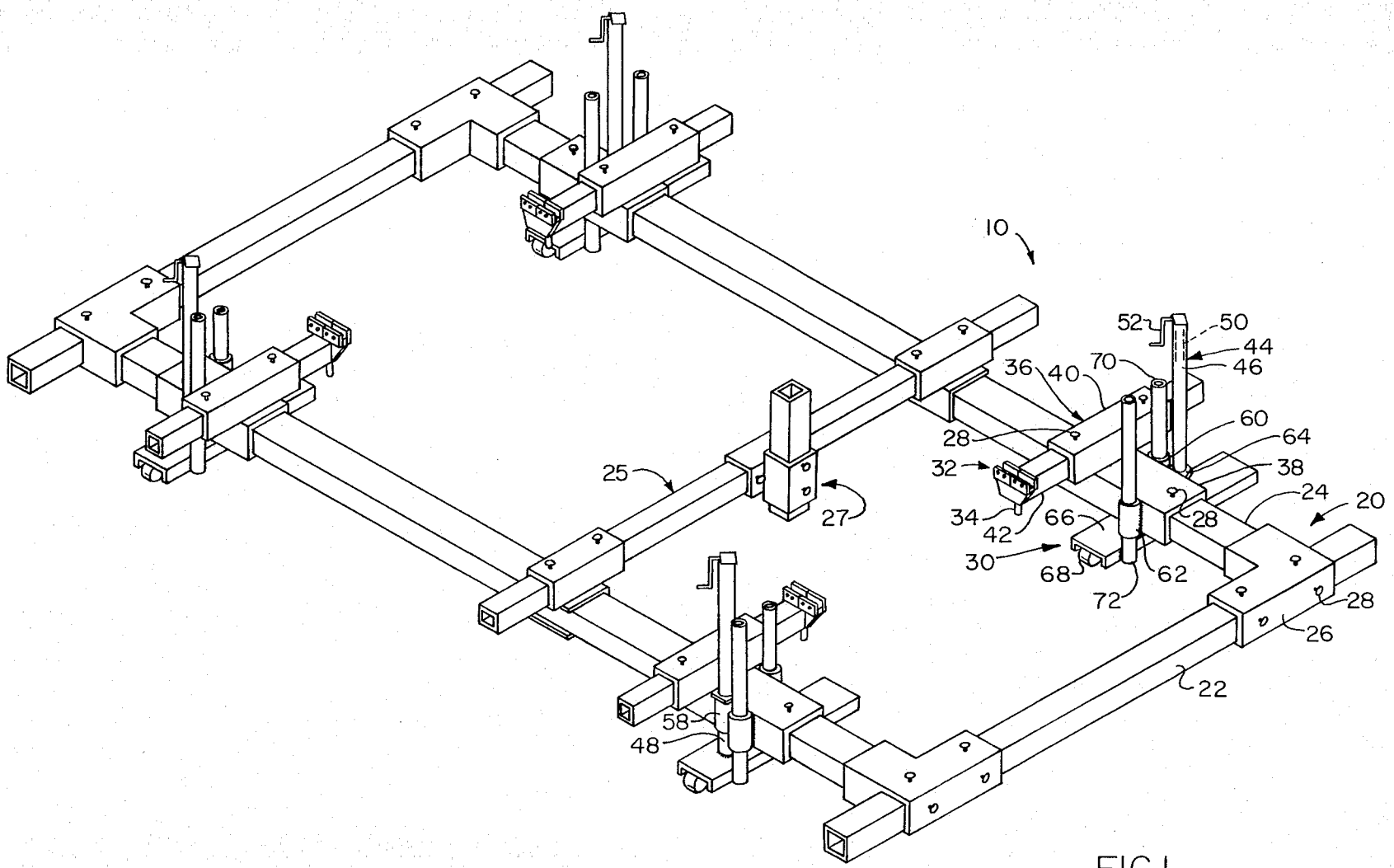
FIG. 1 is a perspective view of the overall system.

FIG. 1 shows the invention in embodiment 10.

The mechanism includes provisions previously described in my said co-pending application: a rectangular adjustable-width frame 20 of rectangular-section tubing parallel-spaced end rails 22 adjustably assembled to similar parallel-spaced side rails 24 by "L"-shaped connectors 26 detachably fastened to the ends of the side rails.

The "L" shaped connectors are of rectangular tubing sized to make a free-sliding fit with the end rails, which can be adjustably fixed in sliding position in the "L"-shaped connectors by headed set-screws 28. Also, 25 is an adjustable crossbar for pushing and pulling operations under a vehicle body with a vertically adjustable fulcrum 27 on it.

The invention provides new combinations. Supporting the frame 20 above the floor are four adjustable gripper/jack means or stands, 30. The grippers 32 are on the ends of gripper arms 42 and hold the pinch welds on vehicles with unitary body and frame construction. Alternatively the gripper arms can be withdrawn from the rectangular hole in the cross slide 36 and rotated 180° about the long axis to position studs 34 for insertion into the openings provided in separate-frame type vehicles for holding them.

By means of cross-slides 36 the gripper/jack assemblies adjustably mount to the side rails. Each cross slide 36 includes a first length of rectangular tubing 38 slidably mounted on a respective side rail and having headed set screws 28 to fix it in position, and a second length of rectangular tubing 40 welded at right angles on the first and slidably holding in it a respective gripper arm 42, part of a laterally positioning means, and adjustably fixed in position by headed set-screws 28, with the gripper 32 inboard.

By this provision, the jacking means moves the gripping means but the gripping means can move laterally without concurrent movement of the jacking means.

The jacking portion includes preferably a conventional screwjack 44 with fixed outer tube 46 and sliding inner tube 48 driven by a screw 50 actuated at the top of the assembly by a crank 52 which can be swung up for operation in turning the screw. This is the type often employed on house-trailer hitches, although other suitable conventional jacks can be used.

The first length of rectangular tubing 38 of each cross-slide has welded it to three vertical sleeves, 58, 60, 62. The first sleeve 58 which is on the outboard side of the rectangular tubing has a flange 64 around the upper end and the fixed outer tube 46 of the screw jack is held in this first sleeve and attaches by bolts to the flange.

The sliding inner tube 48 of the screw-jack protrudes downwardly to welded attachment to a base 66 equipped with a castor 68 at each end. The second sleeve 60 is on the outboard side of the first length of rectangular tubing 38 and slidably holds a supportive guide 70, which is affixed at the lower end to the base 66.

The third sleeve 62 is on the inboard side of the first length of rectangular tubing 38 and similarly holds a second guide 72 which also is attached to the base.

Figure 2:
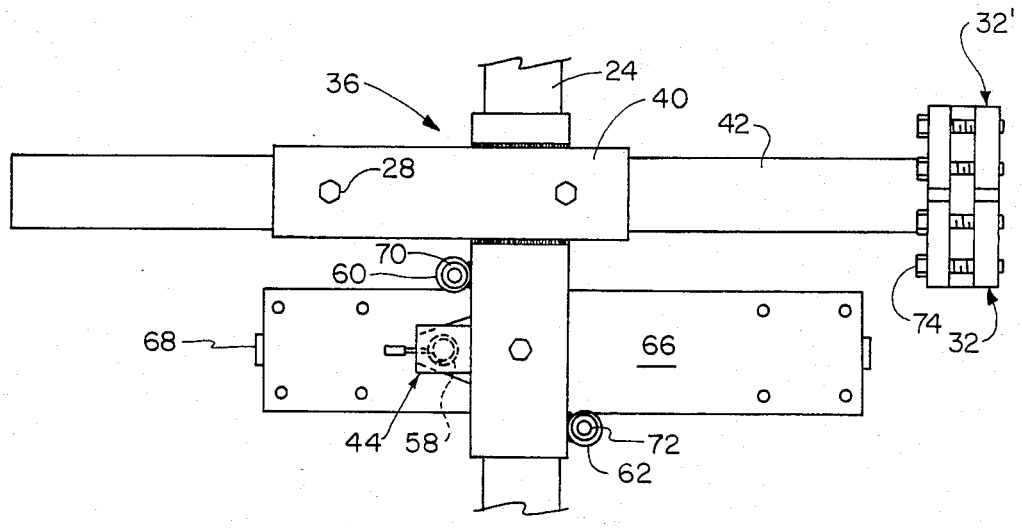
FIG. 2 is a plan detail of an integrated jacking and gripping subassembly.

FIG. 2 shows the plan relation of a side rail 24, screwjack 44, sleeves 58, 60, 62, guides 70, 72, base 66, castors 68, cross-slide 36, gripper arm 42, paired grippers 32, 32', gripper tightening machine screws 74, and headed set screws 28. The base 66 is substantially aligned in parallel with the member 40.

The grippers are employed in linearly aligned pairs, side by side for load spreading and security.

Figure 3:
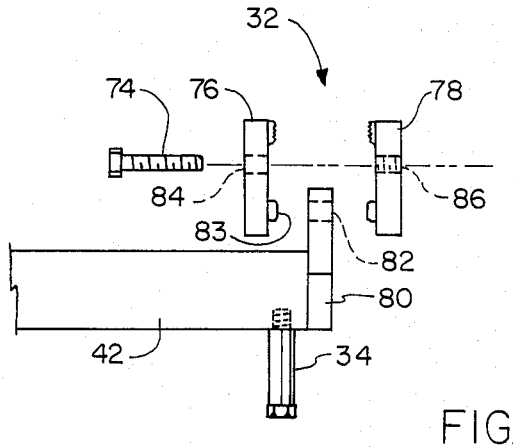
FIG. 3 is a fragmentary exploded elevational view of a gripper detail.

FIG. 3 details the gripper mechanism at 32. Opposed gripper jaws 76 and 78 sandwich between them at upright plate 80 welded on the end of the gripper arm 42.

The upright flange plate 80 has two side-by-side clearance holes 82 for each set of gripper jaws and a pair of fixed spuds 83 on each jaw protrudes in respective holes and preserves jaw alignment. A machine screw 74 passing through each of two side-by-side clearance holes 84 in the first jaw 76 threads into coaxially corresponding tapped holes 86 in the second jaw 78 and draws the jaws towards each other for gripping. The jaws are a commercial product of the Porter Furgerson Company and no claim is made to them specifically; other screw-tightenable upward opening jaws might be as suitable. 34 is the stud (FIG. 1).

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by U.S. Letters Patent is:

1. In a system for body and frame straightening, having: a plurality of rails, means for adjustably assembling said plurality of rails as a rectangular frame, a plurality of jacking means for carrying and raising and lowering said plurality of rails, a base on each jacking means, a first member on each jacking means, each first member mounted on a said rail and permitting positioning each jacking means by movement along said rail, a plurality of means for gripping a said body, and means for permitting laterally positioning each said gripping means laterally of a said rail, the improvement comprising: means for requiring movement of a said means for permitting laterally positioning, upon any said movement of a jacking means along a said rail; each means for requiring movement including: a second member fixed on each first member transverse to said rail and each said jacking means base fixed to a respective first member parallel to said second member, each means for gripping including a pair of grippers laterally aligned, and each means for permitting laterally positioning including an arm slidably mounted in said second member and having an upright flange thereon mounting said pair of grippers.

* * * * *